US007370703B2

(12) United States Patent
Hill et al.

(10) Patent No.: US 7,370,703 B2
(45) Date of Patent: May 13, 2008

(54) DOWNHOLE HYDRAULIC PIPE CUTTER

(75) Inventors: Freeman L. Hill, Houston, TX (US); Douglas W. Spencer, Traverse City, MI (US); Jerry E. Miller, Traverse City, MI (US); Chris Walter, Empice, MI (US)

(73) Assignee: Baker Hughes Incorporated, Houston, TX (US)

( * ) Notice: Subject to any disclaimer, the term of this patent is extended or adjusted under 35 U.S.C. 154(b) by 114 days.

(21) Appl. No.: 11/298,784

(22) Filed: Dec. 9, 2005

(65) Prior Publication Data

US 2007/0131410 A1 Jun. 14, 2007

(51) Int. Cl.
*E21B 29/00* (2006.01)

(52) U.S. Cl. ..... 166/298; 166/55.8; 82/82

(58) Field of Classification Search ..... 166/298, 166/55, 55.1, 55.7, 55.8, 66.4; 82/82, 71, 82/100

See application file for complete search history.

(56) References Cited

U.S. PATENT DOCUMENTS

| | | | | |
|---|---|---|---|---|
| 1,358,818 | A | 11/1920 | Bering | |
| 2,117,050 | A * | 5/1938 | Wilson | 166/55.7 |
| 2,117,594 | A * | 5/1938 | Barrett | 166/55.7 |
| 2,160,691 | A * | 5/1939 | Edwards | 166/55.6 |
| 3,859,877 | A | 1/1975 | Sherer et al. | |
| 3,942,248 | A * | 3/1976 | Sherer et al. | 30/97 |
| 4,389,765 | A * | 6/1983 | Thompson, Jr. | 29/426.5 |
| 5,054,976 | A * | 10/1991 | Akesaka et al. | 409/143 |
| 5,368,423 | A | 11/1994 | Hanna | |
| 6,827,147 | B2 | 12/2004 | Dallas | |
| 6,868,901 | B2 | 3/2005 | Mason | |
| 2003/0143047 | A1 | 7/2003 | Ishii et al. | |
| 2005/0079023 | A1 | 4/2005 | Tart et al. | |
| 2005/0133224 | A1 | 6/2005 | Ruttley | |
| 2006/0016603 | A1 | 1/2006 | Webster et al. | |

* cited by examiner

*Primary Examiner*—Jennifer H. Gay
*Assistant Examiner*—Daniel P Stephenson
(74) *Attorney, Agent, or Firm*—Bracewell & Giuliani LLP

(57) ABSTRACT

The casing cutter disclosed herein is useful for severing downhole tubulars and comprises a body, slips, a cutting head, cutting blades, and actuators for operating the cutting head and cutting blades. The casing cutter can be anchored within casing wellbore with the slips to provide anchoring support during the cutting operation. Cutting is accomplished by rotatingly actuating the cutting head with an associated motor, and then radially extending the cutting blades away from the cutting head. The cutting blades are actuated by a hydraulic motor operatively coupled to the cutting blades by a series of gears.

29 Claims, 7 Drawing Sheets

DOWNHOLE HYDRAULIC PIPE CUTTER

BACKGROUND OF THE INVENTION

1. Field of the Invention

The disclosure herein relates generally to the field of severing a tubular member. More specifically, the present disclosure relates to a method and apparatus for cutting downhole tubulars.

2. Description of Related Art

As is well known, hydrocarbon producing wellbores 2 are lined with tubular members, such as casing 4, that are cemented into place within the wellbore 2. Additional members such as packers and other similarly shaped well completion devices are also used in a wellbore 2 environment and thus secured within a wellbore 2. From time to time, portions of the casing 4 (or other tubular devices) may become unusable and require replacement. On the other hand, some tubular segments have a predetermined lifetime and their removal may be anticipated during completion of the wellbore 2. Because downhole tubulars are often secured to the wellbore 2, the tubular must be radially severed at some point along its length in order to remove it from the wellbore 2. Radially severing a tubular usually involves disposing a downhole tool 6, such as a tubing cutter, within the well bore 2 for cutting the tubular.

In FIG. 1, one example of a prior art device is illustrated. The downhole tool 6 can be supplied with an anchoring system 10 that anchors the tool 6 within the casing 4 prior to a cutting operation. Integral with the tool 6 often is a cutter mechanism 8 on which cutter blades 9 are attached. Actuation means associated with the downhole tool 6 are used for rotation of the cutting head where the cutting head includes cutting blades used for severing the casing 4. Once the casing 4 is severed, the portion of the casing 4 above the incision can be removed from within the well bore 2. Generally these downhole tools 6 are disposed within the well bore 2 via a wireline 12 extending from a surface truck 18 through pulleys 16. The wireline should be strung through a packoff head 14 at the surface to ensure sealing within the well bore 2. Examples of such cutting devices can be found in Bering, U.S. Pat. No. 1,358,818, Scherer et al., U.S. Pat. No. 3,859,877, and Hanna, U.S. Pat. No. 5,368,423.

However each of these devices suffer from one or more of the following disadvantages. For example, none of the devices in the above cited references have addressed the issue of how a cutter might respond to variations of material or material density in the material that is being severed. Often the casing, or other tubulars, can have inherent inconsistencies within the casing material causing the hardness and/or toughness of the material to vary at different spots along the circumference of the tubular. This can lead to the production of shock impulses within the cutting devices capable of damaging the device. Other disadvantages of these devices involve the cut itself. Many of these devices produce an uneven or irregular cut along the severed surface of the tubular. There are currently no provisions for producing an even and consistently cut surface along the severed area. Therefore there exists a need for a responsive casing cutter having the ability to produce consistent clean cuts along the circumference of tubular.

BRIEF SUMMARY OF THE INVENTION

The present method herein disclosed includes an embodiment of a tubular cutting device. An embodiment of a tubular cutting device comprises a cutting head, a cutting blade disposed on the cutting head, a first actuator coupled with the cutting head, and a second actuator coupled with the cutting blade, wherein the second actuator comprises a hydraulic system in operative cooperation with a gear arrangement. Optionally, the hydraulic system provides a responsive capability to the cutting blade for reacting to variances in a cutting material. The first cutting arm may be slidingly coupled with the cutting head in a coplanar orientation and extendable past the outer perimeter of the cutting head.

DETAILED DESCRIPTION OF THE INVENTION

Figure 1:
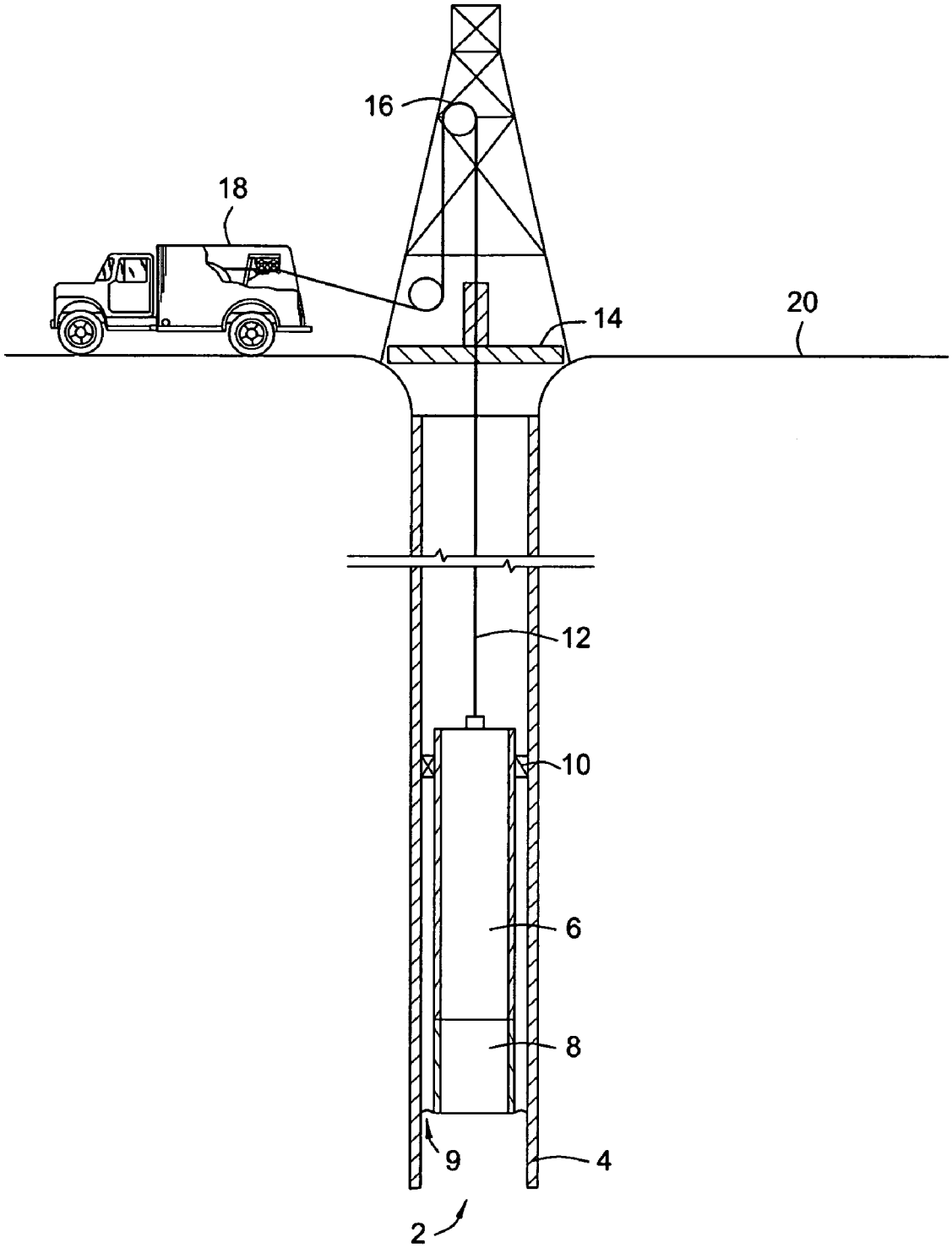
FIG. 1 (PRIOR ART)
FIG. 1 illustrates a partial cut-away side view of a cutting tool disposed in a wellbore.
Figure 2:
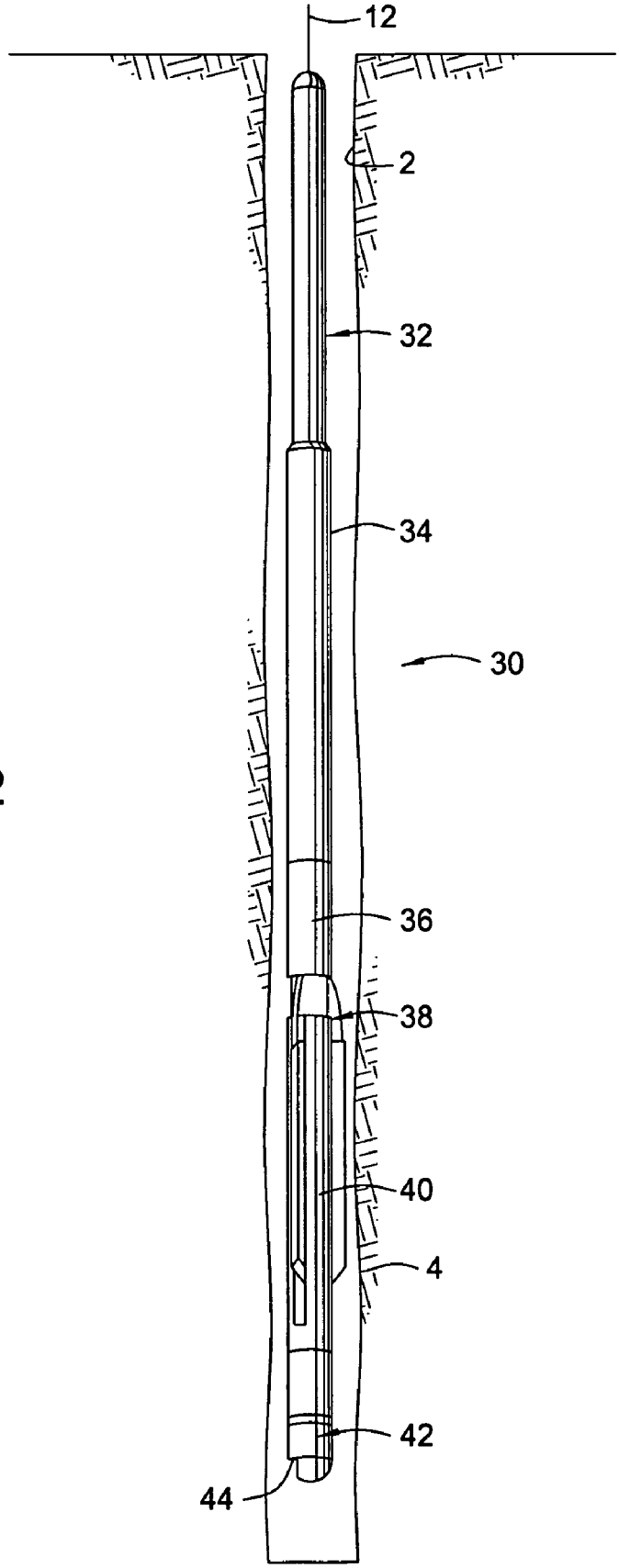
FIG. 2 is a side view of an embodiment of a cutting tool of the present disclosure.

With reference now to FIG. 2, one embodiment of a casing cutter 30 in accordance with the present disclosure is illustrated in a side view. This embodiment of the casing cutter 30 shows it disposed within the casing 4 of a well bore 2. It should be pointed out that the casing cutter 30 of the present disclosure can be disposed within a well bore either by wireline 12, via a downhole tractor, by slickline, or conveyed by tubing. In the embodiment shown, the casing cutter 30 comprises multiple segments; the upper portion 32 of the casing cutter 30 is the electronics housing, disposed just below the electronics housing 32 is the tool housing 34. Also shown, is the anchoring system that is comprised of the slip piston 36, slip arm 38, and slips 40. Specific details of the operation of the anchoring system are provided in more detail below. As shown, the lower most portion of the casing cutter 30 employs a cutting head 42 with attached cutting arms 44.

Figure 3:
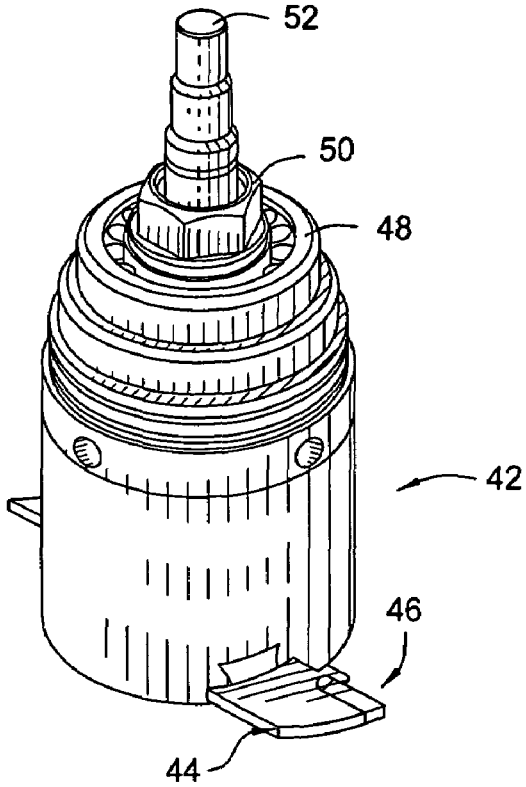
FIG. 3 depicts an embodiment of a cutting head of the present disclosure.

Details of an embodiment of the cutting head 42 are shown in perspective view in FIG. 3. In the embodiment shown in FIG. 3, the cutting head 42 is a substantially cylindrical body having a pair of cutting arms 44 radially disposed at the lower end. Cutting blade inserts 46 are shown attached to the free end of each cutting arm 44. It should be pointed out that the device as described herein can be operated with a single cutting arm 44 or more than two cutting arms 44. One of the advantages of using an insertable cutting blade 46 is the insert can be easily and quickly replaced between uses thereby maintaining a sharpened cutting blade 46 for use in subsequent operations. Also, the inherent frangible nature of the insertable cutting blade 46 enables it to be easily retrieved from a downhole cutting operation should the blade 46 become wedged in the object being cut or otherwise non-retrievable during a cut. Optionally, the cutting blades 46 can be carbide tipped.

Bearings 48 are incorporated on the upper portion of the cutting head 42 thereby reducing frictional contact with the rest of the casing cutter 30. A spindle nut 50 can be used in maintaining the bearings 48 around the cutting head spindle 52. Rotational energy can be imparted onto the cutting head 42 under the spindle 52.

Figure 4:
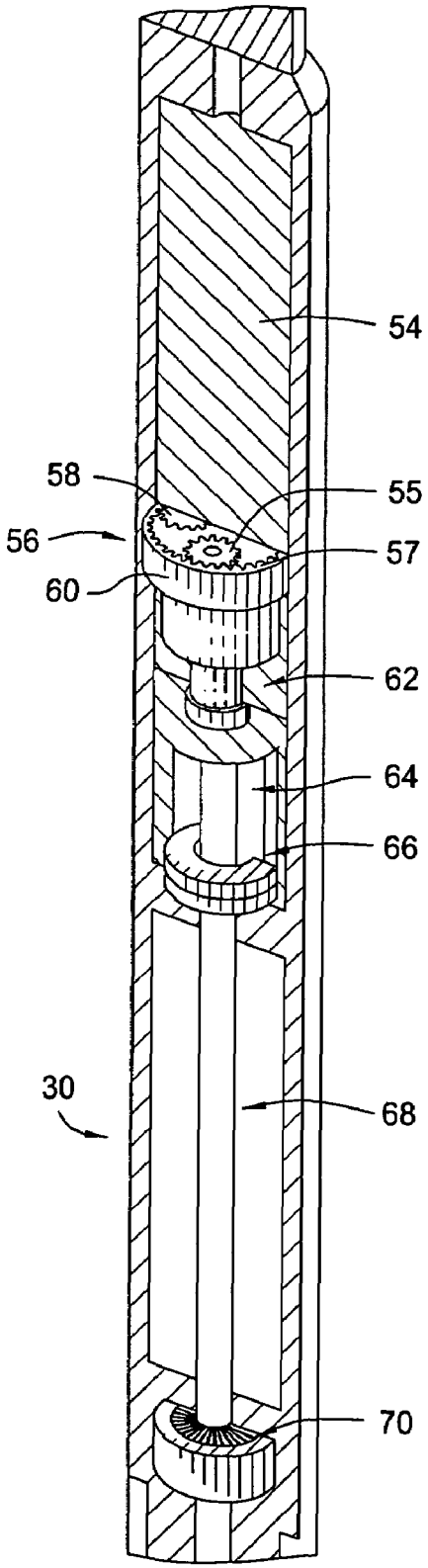
FIG. 4 portrays a partial cut-away perspective view of a portion of an embodiment of the cutting tool of the present disclosure.

In the embodiment shown in FIG. 4, the mode of force for driving the spindle 52 is supplied via a motor 54 that is connected to a drive shaft 68. The output power and speed of the motor 54 may vary depending on the application for which the tool 30 is designed, however it is well within the scope of those skilled in the art to produce and/or specify an appropriate motor for use with the device disclosed herein. In FIG. 4, a motor drive 55 is shown extending from the motor 54 and coupled with a first stage gear reducer 56 on its end opposite the motor 54. As shown, the motor drive 55 is a cylindrical shaft connected on its first end to the motor 55 and has a pinion gear 57 formed on the end coupled to the first stage gear reducer 56. The pinion gear 57 is supplied with teeth on its outer periphery that mate with matching teeth of planetary gears 58 of the first stage gear reducer 56. Thus operational rotation of the motor drive 55 from the motor 54 rotates the planetary gears 58 within the ring gear 60. As will be described in more detail below, rotating the planetary gears 58 transmits an output rotational force, at a reduced rotational velocity over that received by the first stage gear reducer 56, but with a corresponding increase in rotational torque. A drive shaft 68 is coupled to the output of the first stage gear reducer 56, wherein the drive shaft 68 receives the output rotational force of the first stage gear reducer 56 and transmits it to another portion of the casing cutter 30.

A hydraulic piston pump 64 is shown disposed within the body of the casing cutter 30 just below the first stage gear reducer 56. The hydraulic piston pump 64 receives rotational force from the drive shaft 68 and converts that rotational force from the drive shaft 68 into translational force within the piston pump 64. Converting the rotational force within the piston pump 64 enables the piston pump 64 to impart a pressurizing force onto hydraulic fluid fed to the pump 64. As shown, the hydraulic fluid is stored within the hydraulic reservoir 62 and is fed to the hydraulic piston pump 64 during pressurizing operations. The hydraulic piston pump 64 is equipped with a check valve 66 at the discharge of the pump 64. As discussed in greater detail below, the pressurized hydraulic fluid is selectively used in operating both an anchoring system and the advancement of the cutting blades 46.

Figure 5:
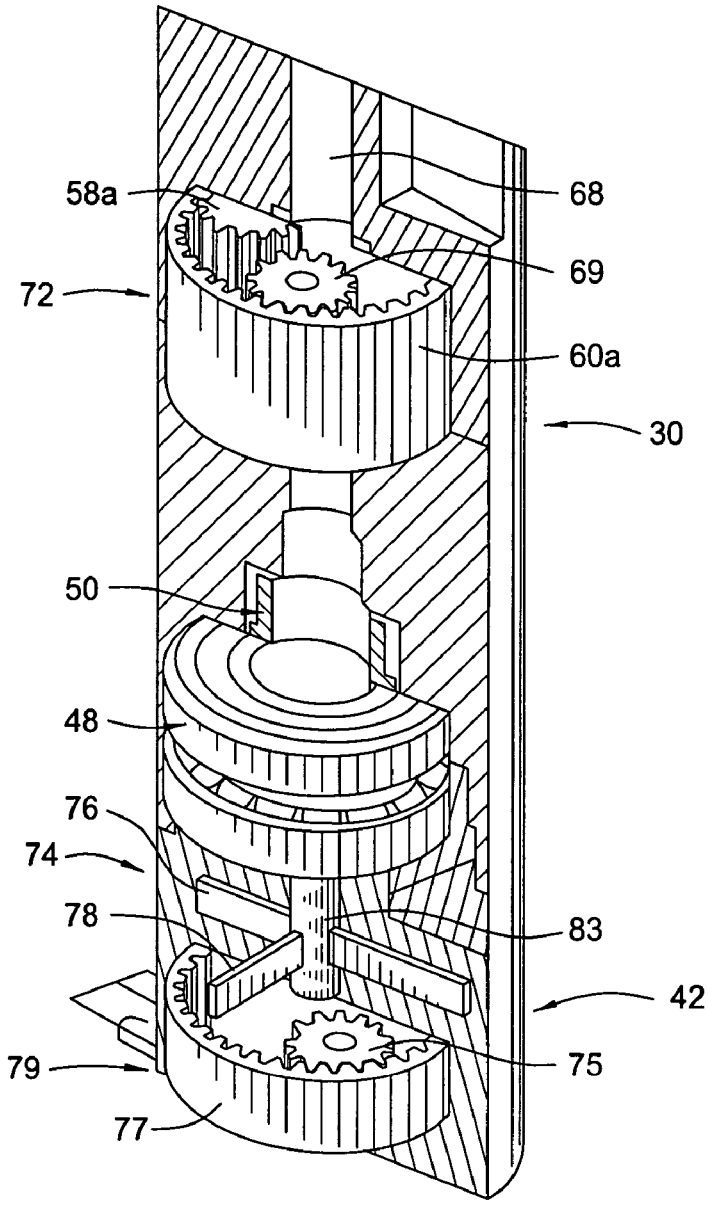
FIG. 5 is a partial cut-away perspective view of a portion of an embodiment of the cutting tool of the present disclosure.

In FIG. 5 displayed is a perspective partial cut away view of an embodiment of the lower portion of the cutting tool 30. This view provides details on how an embodiment of the cutting head 42 is mechanically attached to the remainder of the cutting tool 30. Just above the cutting head 42, and within the body of the cutting tool 30, a second stage gear reducer 72 is shown. As with the first stage gear reducer 56, the second stage gear reducer 72 includes planetary gears 58*a* surrounded by a ring gear 60*a*.

In the embodiment shown, the cutting blade hydraulic motor 74 is comprised of a series of impeller blades 78 disposed within a casing 76. The impeller blades 78 as shown are substantially rectangular and secured to an impeller shaft 83 on one of their respective ends. However the blades 78 could have shapes other than rectangular, such as curved along their length or have a bowl like or hollowed out portion on one side for receiving the pressurized fluid. The output of the cutting blade hydraulic motor 74, via a pinion gear 92 formed on the end of the impeller shaft 83, is coupled to a hydraulic gear reducer 79. As with the other gear reducers, the hydraulic gear reducer 79 includes planetary gears 75 combined with a ring gear 77.

Figure 6:
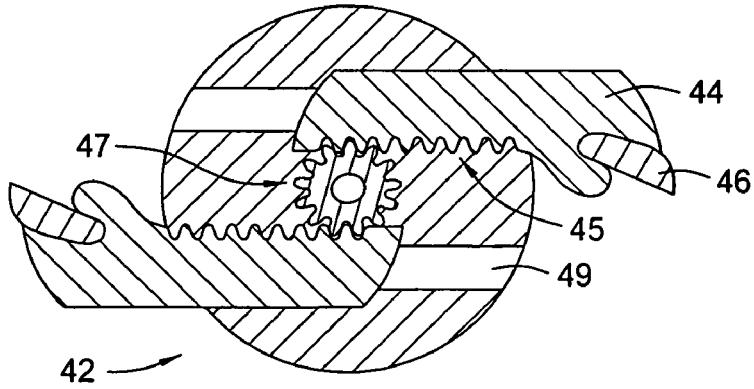
FIG. 6 demonstrates a bottom view of an embodiment of a cutting head of the present disclosure.

FIG. 6 provides a bottom view of an embodiment of the cutting head 42. Cutting arms 44 are disposed on the bottom surface of the cutting head 42 within a groove 49. The cross sectional profile of the groove 49 is preferably a dove-tail profile with a corresponding dove-tail formed on the upper surface longitudinally along the cutting arm 44. Accordingly, each cutting arm 44 can freely slide along the bottom surface of the cutting head 42 in an orientation substantially perpendicular to the axis of the cutting head 42. Though movement of the cutting arms 44 is precluded from moving in an angular direction with respect to the cutting head 42. As such, the arms 44 can be rigidly held in place on the cutting head 42 while the cutting head 42 is rotating during cutting operations. Also situated on the bottom surface of the cutting head 42 is a cutting advance gear 47. The advance gear 47 lies coaxially with the bottom surface of the cutting head 42 and transverse to each of the cutting arms 44. The teeth of the cutting advance gear 47 mate with corresponding gear teeth 45 that are linearly disposed along a portion of the length of each cutting arm 44. Thus, rotation of the cutting advance gear 47 (FIG. 6) in the clockwise direction advances each cutting arm 44 radially outward from the cutting head 42. Similarly counter-clockwise rotation of the cutting advance gear 47 draws the cutting arms 44 back within the outer perimeter of the cutting head 42. It should be pointed out that the cutting advance gear 47 is in mechanical cooperation with the cutting blade hydraulic motor 74 and thus receives its rotational force from the motor 74.

Figure 7:
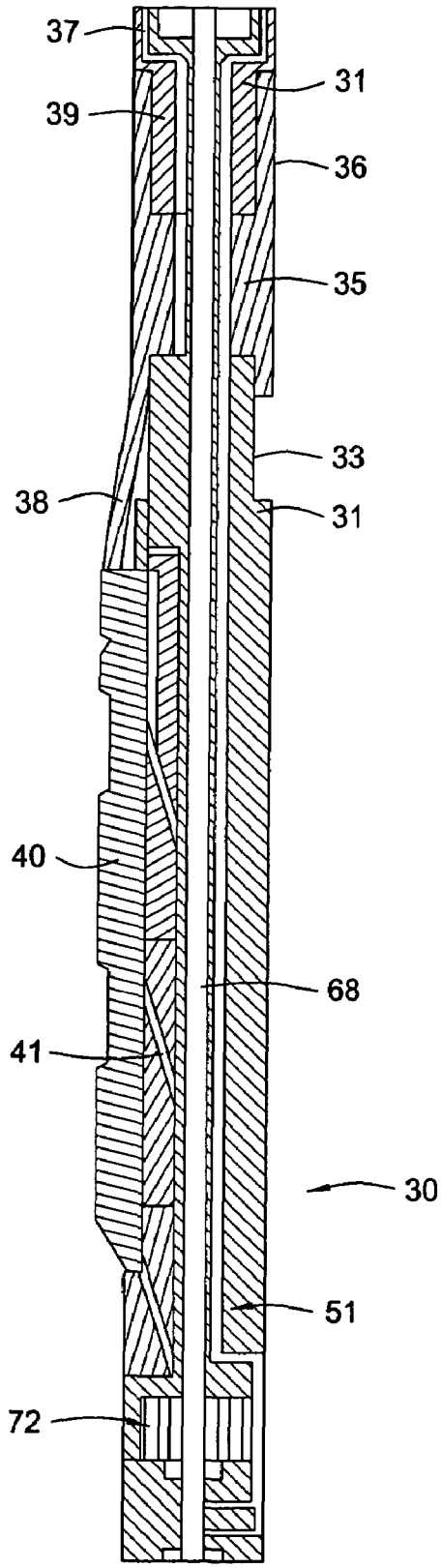
FIG. 7 is a cut-away perspective view of a portion of an embodiment of the cutting tool of the present disclosure.

A graphical presentation of an embodiment of the slip assembly is illustrated in a partially cut away side view in FIG. 7. The slip assembly of FIG. 7 comprises slips 40, slip incline surface 41, slip arm 38, and slip piston 36. The slip piston 36 is substantially cylindrical along its length with an inwardly protruding lip 35 that exists along a portion of its axial length. Formed within the body of the casing cutter housing is a cylinder 39 that is an annular hollow space coaxially to the piston lip 35. A recess 33 is formed along the outer surface of the casing cutter 30. The presence of the recess 33 enables axial movement of the piston along the length of the casing cutter 30. Shoulders 31 at distal ends of the recess 33 provide a butting surface for limiting the axial travel of the piston 36 along the cutting tool 30.

By selectively pressurizing the cylinder 39 on either side of the lip 35, the piston 36 can be moved either upward or downward along the length of the casing cutter 30. A slip arm 38 is attached on one end to the slip piston and on its other end to the slips 40. The rigid attachment of the slip arm 38 to the piston 36 and slips 40 correspondingly causes axial movement of the slips 40 along the length of the casing cutter 30 that coincides with the movement of the slip piston 36. A slip incline surface 41 is provided on the body of the cutting tool 30 for mating cooperating with a similar incline on the bottom surface of the slip 40. Thus by moving the slip 40 in an upward direction the slip 40 is also pushed radially outward from the body of the casing cutter 30. Eventual outward urging of the slip 40 can thereby impinge the slip 40 on the inner surface of a corresponding casing 4 when the casing cutter 30 is disposed within a cased well bore 2. The hydraulic fluid ported to and from the slip piston is provided via slip hydraulic porting 37. The slip actuating system maintains a constant working volume during operations. Any volume of fluid that enters one end of the cylinder 39 is balanced by an equal amount of fluid exiting the other end.

Figure 9:
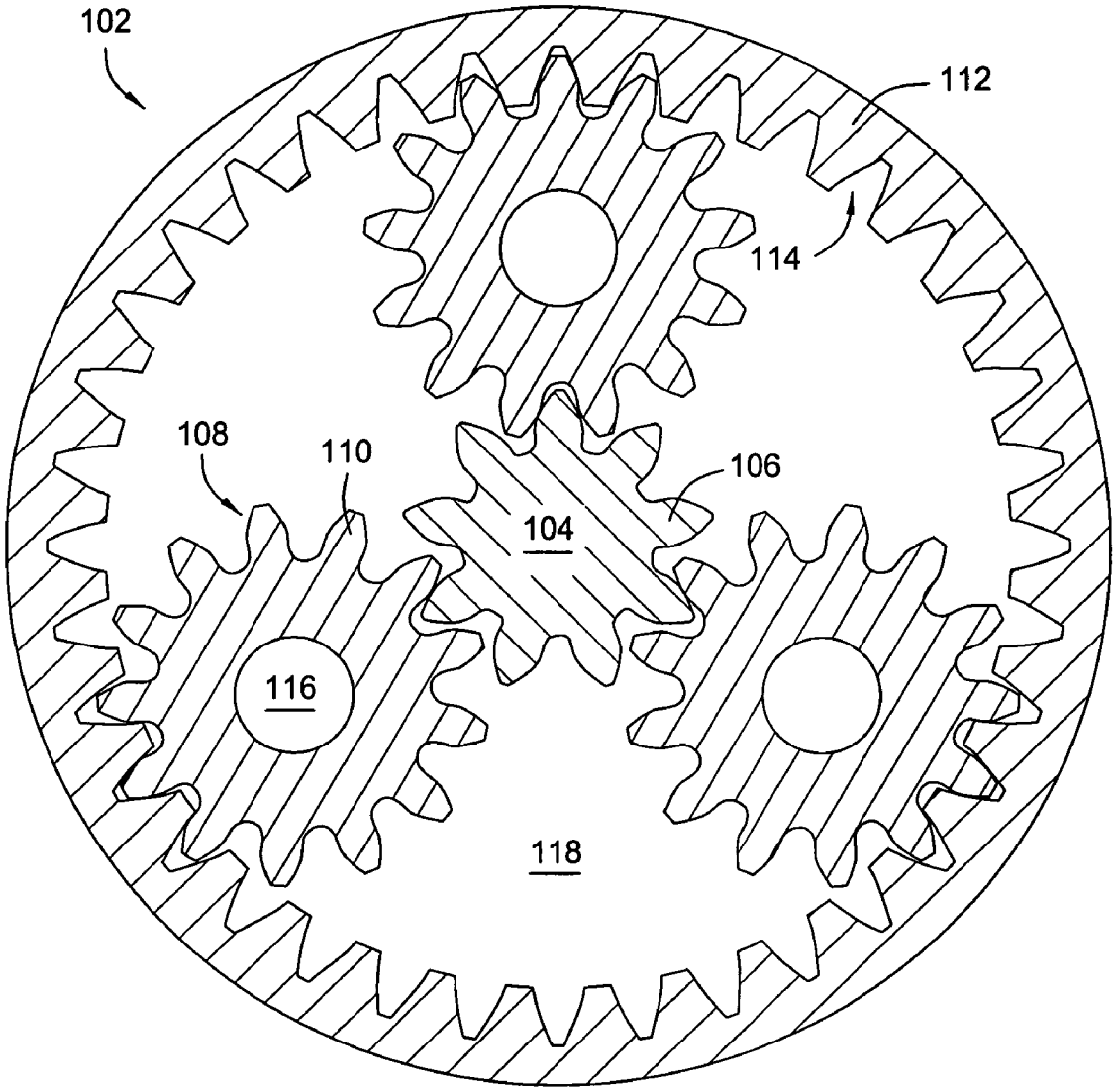
FIG. 9 is a side view depicting elements of a gear reducer.
Figure 10:
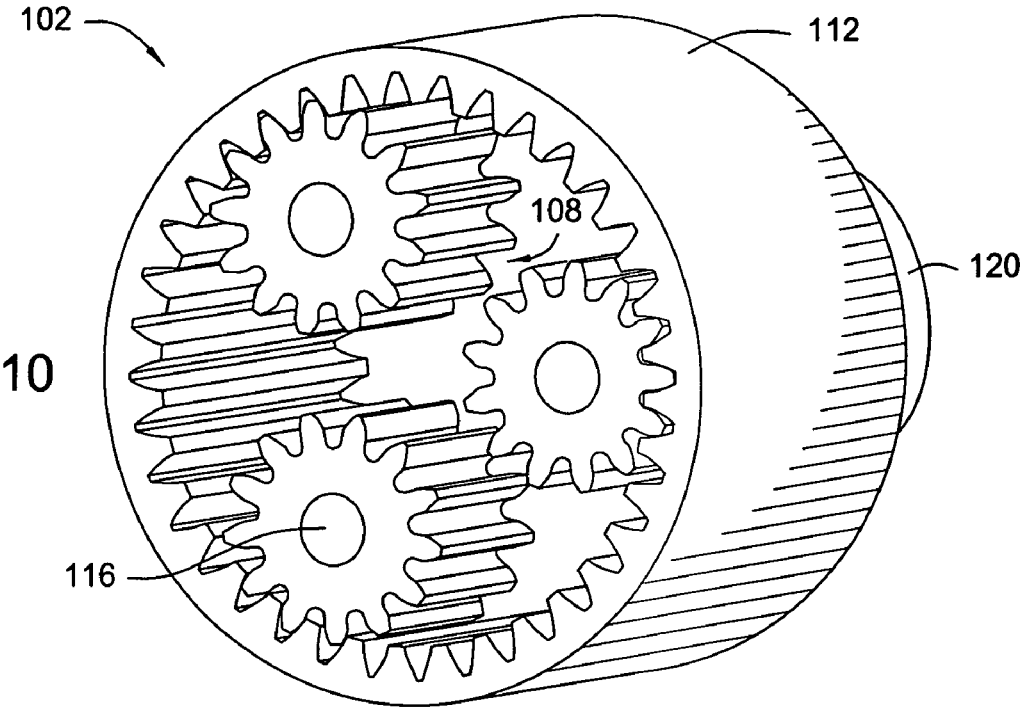
FIG. 10 is a perspective view of the front or upper view of a gear reducer.
Figure 11:
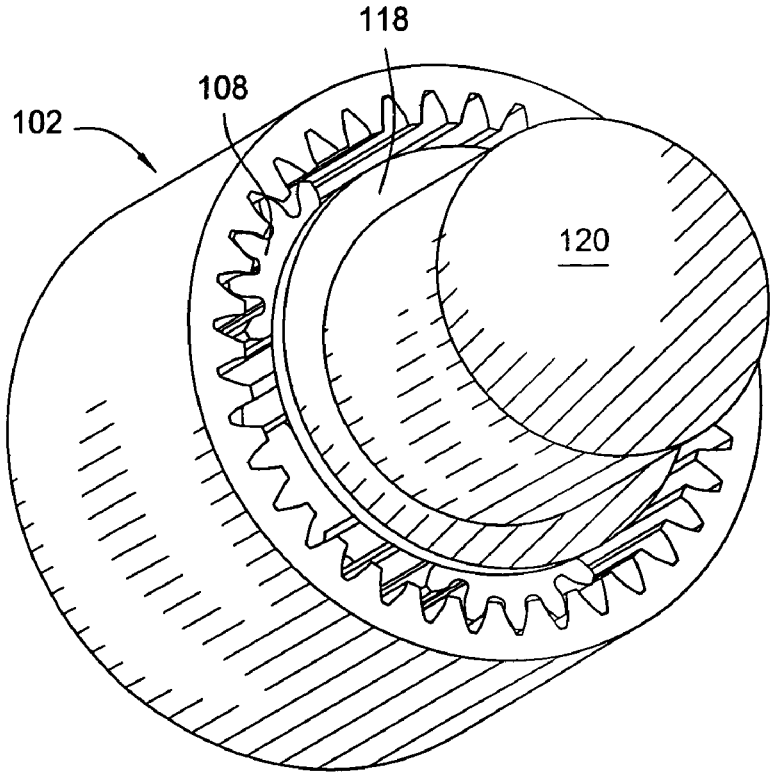
FIG. 11 is a perspective view of the rear or lower view of a gear reducer.

An example of a gear reducer 102 for use with the device disclosed herein is shown in FIGS. 9, 10, and 11. FIG. 9 provides an overhead or upper view of the gear reducer 102, where the gear reducer 102 comprises a pinion (or sun) gear 104 whose teeth 106 are meshed with the teeth 110 of planetary gears 108, wherein the planetary gears 108 are substantially coplanar with the pinion gear 104. Each of the planetary gears 108 are mounted on a post 116 such that the planetary gears 108 are able to rotate freely around their respective post 116. Each post 116 is secured to a base plate 118 that resides below the plane containing the sun gear 104 and the planetary gears 108. Although the base plate 118 is at a different elevation than the gears (104, 108), it is substantially co-planar with the sun and planetary gears (104, 108).

The pinion gear 104 is connected to a rotational source, such as a rotating shaft (not shown) for rotating the pinion gear 104. Due to the meshing of their respective teeth (106, 110), rotating the pinion gear 104 produces corresponding rotation of each of the planetary gears 108. Also coupled to the planetary gears 108 is a ring gear 112 that coaxially circumscribes the planetary gears 108. The ring gear 112 is cylindrical with recessed teeth 114 longitudinally formed along its inner radius. The recessed teeth 114 are shaped to mesh with the teeth 110 formed on the outer radius of the planetary gears 108. The ring gear 112 is held stationary and not allowed to rotate, thus the interaction of the teeth (110, 114) during rotation of the planetary gears 108 causes the planetary gears 108 to "ride" along the inner circumference of the ring gear 112. As the planetary gears 108 ride along the inner circumference of the stationary ring gear 112, an angular force is imparted to the posts 116 and onto the base plate 118. Thus the base plate 108 is rotated with respect to the ring gear 118 as the planetary gears 108 ride within the inner circumference of the ring gear 112. Due to the gear ratios between the pinion gear 104 and the planetary gears 108, the rotation of the base plate 118 rotates at a decreased velocity than the pinion gear 104 but with increased torque.

Referring now to FIGS. 10 and 11, perspective views of the gear reducer 102 are provided that include the shaft 120. The shaft 120 is attached to the base plate 118 on the side of the base plate 118 opposite the posts 116. Accordingly, when the base plate 118 is rotating, the shaft 120 will rotate at the same velocity of the base plate 118 with the same torque. Thus to utilize the output of the gear reducer 102, a rotational shaft or gear is attached to the shaft 120. Additionally, a two stage gear reducer can be produced by adding a pinion gear to the shaft 120 that is coupled to a second set of planetary gears with a corresponding base plate.

In one mode of operation of the device herein described, the casing cutter 30 is lowered within the well bore 2 via a wireline 12, tubing conveyed, or any other manner of disposing a downhole tool within a wellbore. When it has been determined that the tool is in the proper position for cutting the tubular, the power supply can then be activated in a high voltage mode. Power is delivered to the cutting tool 30 from the surface 20 via the wireline 12 or other disposing means. During the power up of the casing cutter 30, the motor 54 would begin to draw current that can be monitored at the surface 20 via connection through the wireline 12 or other connected means. Optionally a short pause can be provided for any power cycling that may occur. The motor 54 then begins rotating the drive shaft 68 and in turn powers the hydraulic piston pump 64. Preferably a solenoid valve 67 provided within the tool would be set such that upon original activation of any pressure into the hydraulic circuit 80 the system will proceed into the retract mode.

Figure 8:
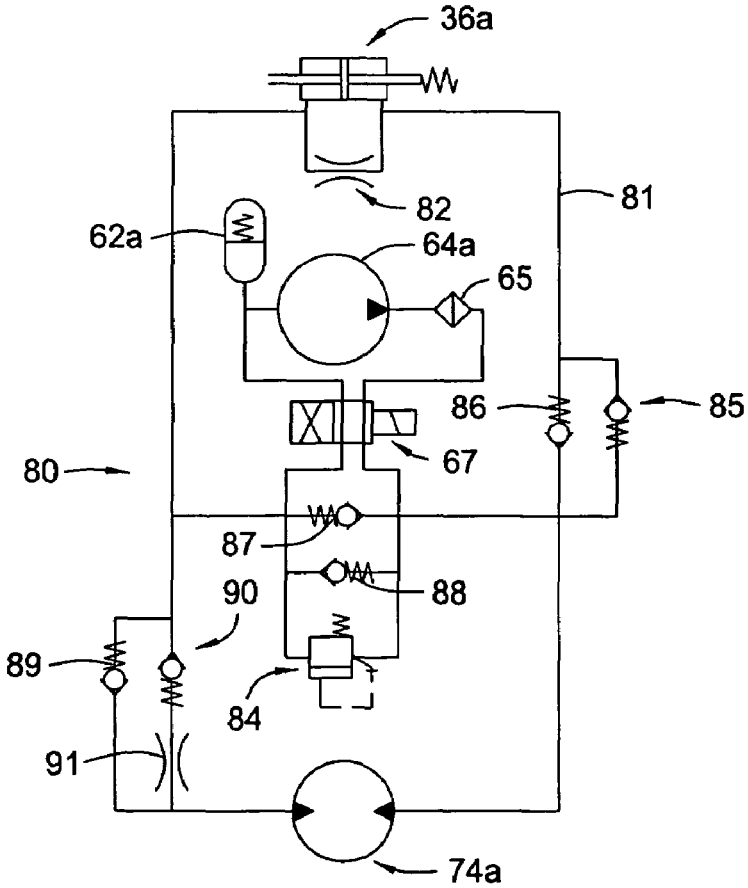
FIG. 8 is a schematic view of an embodiment of a hydraulic system of the present disclosure.

One embodiment of a hydraulic circuit useful with the device disclosed herein is illustrated in schematic view in FIG. 8. As shown, hydraulic pressure is produced by the hydraulic pump 64*a* wherein the pressurized hydraulic fluid is then directed to the solenoid valve 67. The solenoid valve 67 is capable of directing flow within the circuit in different directions to accomplish different purposes. As shown in FIG. 8, the hydraulic flow directed by the solenoid valve 67 puts the hydraulic circuit 80 in the retract mode, that is, in this configuration operation of the hydraulic pump 64*a* would cause the slips 40 to move into a retracted mode and the cutter blades 46 would also retract within the outer perimeter of the cutting head 42. However, the direction of the hydraulic flow through the hydraulic circuit 80 can be reversed by activation of the solenoid valve 67 thereby putting the hydraulic system 80 into the extend mode. In the extend mode the slips 40 are pulled upward into an anchoring position, and the cutting arms 44 are extended radially past the outer perimeter of the cutting head 42.

With regard to the schematic, hydraulic lines 81 are illustrated that provide hydraulic fluid communication between the various components of the hydraulic system 80 of the casing cutter 30. Also shown is a bypass 82 around the slip piston 36*a* that includes an orifice for reducing pressure across the bypass 82. The presence of the bypass 82 allows a settling out of the hydraulic system should the system be inadvertently powered down. The settle out condition would allow the slips 40 to automatically retract thereby enabling extraction of the casing cutter 30 from within a well bore 2 without the need to overcome the anchoring force of the slips 40. The hydraulic circuit 80 is provided with a series of check valves (85, 86, 87, 88, 89, and 90). As will be discussed in more detail below, the presence of the check valves and their respective set pressures provides for sequential operation of the slips 40 and the cutting blades 46.

Upon reaching the retracted position, the pressure within the hydraulic circuit will rise to a predetermined level equal to the set pressure of the check valve 87. The subsequent increase in electrical current being delivered to the motor 54 can be monitored and detected by a downhole current sensor, this would signal the completion of the retract sequence. Optionally on completion of the retract sequence, the motor 54 can then be powered down and paused in the fully retracted position. The operator has the option to power the casing cutter 30 down completely and extract the cutter 30 from downhole or continue in the power on mode to complete a cutting operation. Should it be determined to complete a cutting operation, the solenoid valve 67 will be actuated in order to reverse the flow of hydraulic fluid from the retract position to the "extend and cut" mode.

As previously described, operation of the motor 54 powers the hydraulic piston 64 that in turn imparts rotation onto the cutter head 42. Because the device is in the extend mode, hydraulic fluid will begin flowing into the cylinder 39 below the lip 35 of the slip piston 36. This increased pressure in turn moves the piston 36 upward thereby pulling the slip 40 upward as well. As previously discussed, this anchors the casing cutter 30 within the tubular in which it is disposed. When the slips are fully engaged within the casing or tubular, the system pressure will begin rising again. Continued pressure increase within the hydraulic circuit will ultimately overcome the set point of the check valve 90 which then allows hydraulic fluid to flow towards the cutting blade hydraulic motor 74. The cutter blade hydraulic motor 74 then causes rotation of the gears in the hydraulic gear reducer 79. The hydraulic gear reducer 79 increases the output torque of the hydraulic motor 74 similarly reducing its output velocity. The rotational motion of the cutter blade power train is converted to linear extension of the cutting arms 44 via the rack and pinion system (47 and 45) disposed on the cutting head 42. The central pinion or cutting advance gear 47 advances both cutting arms 44 simultaneously. The cutting blades 46 disposed at the distal end of the cutting arm 44, away from the cutting advance gear 47, contact the inner diameter of the tubular to be cut. This cutting contact in combination with the rotation of the cutting head 44 can thereby adequately sever the tubular from within.

It should pointed out that optionally one of the cutting arms can be disposed in such a way that it "trails" the other cutting arm. Specifically the trailing cutting arm would be less extended than the non-trailing arm such that the leading arm performs the cutting action alone. The trailing arm is then able to "dress" the cut and remove remaining shards or other uneven or protruding portions of the cut surface, this therefore produces a cleaner cut. Optionally the trailing cutting arm can also act as a redundant cutting mechanism thereby adding additional assurance that the cutting action has redundancy should the primary cutting arm fail for any reason.

Depending on the particular application, the outward radially extending motion of the cutting arms 44 can be terminated when they reach their physical limit of travel, i.e. when the rack gear teeth 45 have reached their linear limit. Also any outward travel can also be limited by implementing a predetermined hydraulic pressure limit within the system 80 or a predetermined time limit can be included with the operation this device. If any of these terminal conditions are met, the solenoid valve 64 can then be switched such that the hydraulic system 80 is returned to the retract position. As previously noted, the retract position would thereby move the cutting arms 44 inward within the outer perimeter (or radius) of the cutting head 42 and also cause the slips 42 to be moved downward along the length of the casing cutter 30 and away from the inner diameter of the tubular in which the casing cutter 30 is disposed.

Optionally an over running clutch 70 can be included with the present device that is axially disposed along a length of the drive shaft 68 between the secondary stage gear box 56 and the cutting head 42. Implementation of the over running clutch 70 would allow for operation of the hydraulic system 80 without the requirement of rotating the cutting head 42. This clutch 70 can allow torque and rotation to be transmitted in only one direction. If the motor 54 is reversed in this rotation, the cutting head 42 would in turn stop its rotation, however the hydraulic system 80 could still be pressure powered. Should the cutting head 42 jam during operation due to failure of the cutting blade 46, thereby preventing the hydraulic pump 64 from operating, the over running clutch 70 would allow reverse operation of the motor 54 and the hydraulic piston pump 64. Optionally, the cutting blades 46 can be included with a predetermined weak point which would allow for purposeful fracturing of the cutting blade should the device become stuck during operation. Along with the fail-safe mode of the settle out pressure thereby allowing automatic retraction of the slips 40, this is another contingency mode available for the present device.

When the cutting arms 44 reach their fully retracted position, a system pressure increase will open the slip high set point check valve allowing flow into the retraction side of the cylinder 39. This in turn powers the slips 40 into their closed or fully retracted position close up against the body of the tool housing 34. Once the slips 40 are closed the system pressure will rise and the power limiting check valve at the pump will open. Increased electrical current in the motor 54 will be detected and the tool can then be powered down via command from an associated controller (not shown). With the cutter arms 44 and the slips 40 fully retracted in the power off the casing cutter 30 may be retrieved from within the cased well bore 2.

In one non-limiting example of the present device, the motor 54 is comprised of a single brushless/sensorless DC electric motor. The tool motor, at approximately 1.75 inches in diameter would nominally produce 0.75 horsepower, with an output spindle speed of approximately 3,000 RPM. Optionally the device of this example also includes a DC electric motor having an output power of up to 1 horsepower. The motor output would be coupled to the first stage gear reducer 56, where the first stage gear reducer 56 reduces the spindle rotation at the cutting head 42 to approximately 75 rpm with an output torque of approximately 70 ft/lb. This configuration will engage the cutters with the tubular surface at a cutting tool velocity of approximately 60-70 surface feet per minute.

Preferably, the motor and closed loop controller of this example are rated for temperatures up to 325° C. to allow the instrument to operate in the most demanding wells. A closed loop speed control is included with an example that provides the ability to maintain a constant motor speed over a wide range. Because the motor of this example is a sensorless design, "back EMF" from the motor windings is used by the downhole electronics to control commutation and determine motor velocity. Preferably the cutting head 42 and slips 40 of the example device are configured in a way that allows quick changing without breaching the hydraulic system 80.

Although the cutting head 42 is directly powered by the motor 54 the cutter blades 46 are indirectly powered by the motor 54 due to the implementation of the hydraulic system 80. This approach achieves its results with a hydraulic drive mechanism. Utilizing the hydraulic advance method disclosed herein, the actual advancing speed of the cutting arms as they move radially outward from the cutting head 42 is generally consistent. However this value is dependent upon the load encountered by the cutting blades 46 during operation. The advantage of this variable advance rate is that this configuration is considered self limiting and retards the advance rate of the cutter blade 46 when hard spots or higher casing grades detect the necessity of a reduced cutter arm feed rate. Thus the responsiveness of the hydraulic system 80 enables the casing cutter 30 of the present device to react to density and/or other variations within the material of an associated tubular that is being cut with this device. This flexibility due to material variations can reduce energy spike requirements that can thereby prolong the life of any associated electrical hardware. Moreover, this responsive hydraulic system can also eliminate high-energy loads on the cutting arms 44 and cutting blades 46, which in turn should reduce the likelihood of sudden breakage of this hardware during operation. This feature, combined with the trailing arm feature previously discussed, provides an adding level of redundancy and assurance of operation of the present device.

Optionally, it is possible to replace the hydraulic piston pump 64 with a gear pump (not shown). The gear pump, however, does change the flow direction when the rotational direction is reversed. This eliminates the need for an electrically controlled four-way valve, and basis the extension of retraction control entirely on the rotational direction of the motor.

The apparatus described herein, therefore, is well adapted to attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A tubular cutting device comprising:

a head;

a cutting element disposed on said head;

a first actuator coupled with said head; and a second actuator coupled with said cutting element, wherein said second actuator comprises a hydraulic system in operative cooperation with a gear arrangement, wherein the hydraulic system and gear arrangement are configured to extend the cutting element away from the head into cutting contact with a tubular.

2. The tubular cutting device of claim 1, wherein said hydraulic system provides a responsive capability to said cutting element for reacting to variances in a cutting material.

3. The tubular cutting device of claim 1, wherein the cutting element is slidingly coupled with the cutting head in a coplanar orientation and extendable past the outer perimeter of the cutting head.

4. The tubular cutting device of claim 3, wherein said second cutting element is a trailing arm.

5. The tubular cutting device of claim 3, further comprising a second cutting element wherein said second cutting element is also slidingly coupled with the cutting head in a coplanar orientation and extendable past the outer perimeter of the cutting head.

6. The tubular cutting device of claim 5, wherein the extendable length of said first cutting element exceeds that of said second cutting element.

7. The tubular cutting device of claim 6 wherein the rate of extension of said first and second cutting elements range from about 0.002" to about 0.006".

8. The tubular cutting device of claim 1, further comprising a second cutting element.

9. The tubular cutting device of claim 1 further comprising an anchoring system.

10. The tubular cutting device of claim 9 wherein said anchoring system comprises a piston coupled to an anchoring slip with a slip arm.

11. The tubular cutting device of claim 10 further comprising an inclined surface formed to mate with a corresponding incline of the anchoring slip, such that extension of the anchoring slip along the included surface urges the anchoring slip radially outward from the cutting tool for anchoring the cutting tool within a tubular.

12. The tubular cutting device of claim 9 further wherein said hydraulic system is used in powering said anchoring system.

13. The tubular cutting device of claim 1 further comprising an electric motor.

14. The tubular cutting device of claim 13 wherein said motor is operatively coupled to said head and is capable of providing rotational movement of said head.

15. The tubular cutting device of claim 13 further comprising a hydraulic motor powered by said electric motor.

16. The tubular cutting device of claim 15 wherein said hydraulic motor is capable of powering said hydraulic system.

17. The tubular cutting device of claim 13 further comprising a gear reducer for receiving power from said electric motor, wherein said gear reducer converts rotational speed to torque energy.

18. The tubular cutting device of claim 13 further comprising a closed loop speed control for maintaining constant motor speed over a wide load range.

19. The tubular cutting device of claim 1, wherein said second actuator comprises a rack and pinion gear system.

20. The tubular cutting device of claim 1, wherein said device is disposable in the casing of a hydrocarbon producing wellbore and capable of severing the casing.

21. The tubular cutting device of claim 1, wherein the cutting element is selected from the list consisting of a cutting blade, a cutting disk, a milling disk, a grinding disk, a sawing blade, and combinations thereof.

22. A cutting device useful in severing tubular members comprising:

a housing;

a motor disposed within said housing;

a cutting member slidingly disposed on said housing and selectively moveable perpendicular to the axis of said housing; and a hydraulic system in mechanical cooperation with said cutting member through a gear arrangement, wherein the gear arrangement is configured to move the cutting member away from the housing into a cutting position, wherein implementation of said hydraulic system enables said cutting member to respond to variations in the material of the tubular member being severed.

23. The cutting device of claim 22 further comprising a cutting head formed to engagingly receive said cutting member thereon.

24. The cutting device of claim 22, wherein said motor provides motive force to said hydraulic system and said cutting head.

25. The cutting device of claim 22 further comprising an anchoring system in communication with said hydraulic system.

26. The cutting device of claim 25 wherein said hydraulic system is capable of selectively actuating the anchoring system and the cutting member.

27. The cutting device of claim 26, wherein said selective actuation is performed by increasing the pressure within the hydraulic system to a first set point thereby actuating the anchoring system and increasing the pressure further to a second set point thereby actuating the cutting member.

28. The cutting device of claim 22 further comprising a selector valve.

29. The cutting device of claim 28, further comprising an anchoring system wherein said selector valve is capable of selectively operating the hydraulic system in an extend mode whereby said anchoring system extends into an anchoring position and said cutting member extends into a cutting mode and selectively operating the hydraulic system in retract mode whereby said anchoring system retracts into a retracted position and said cutting member retracts into a retracted mode.

* * * * *